US005120949A

United States Patent [19]

Tomasetti

[11] Patent Number: 5,120,949

[45] Date of Patent: Jun. 9, 1992

[54] SEMICONDUCTOR ANODE PHOTOMULTIPLIER TUBE

[75] Inventor: Charles M. Tomasetti, Leola, Pa.

[73] Assignee: Burle Technologies, Inc.

[21] Appl. No.: 643,179

[22] Filed: Jan. 17, 1991

[51] Int. Cl.[5] ..... H01J 40/14

[52] U.S. Cl. ..... 250/207; 313/532

[58] Field of Search ..... 250/207, 213 VT; 313/532, 533

[56] References Cited

U.S. PATENT DOCUMENTS

| | | | |
|---|---|---|---|
| 3,069,591 | 12/1962 | Sclar | 313/532 |
| 3,851,205 | 11/1974 | Picker | 315/11 |
| 3,887,810 | 6/1975 | Skaggs | 315/11 |
| 4,095,136 | 6/1978 | Niklas | 315/11 |
| 4,628,273 | 12/1986 | Vlasak | 313/532 |
| 4,718,761 | 1/1988 | Tsuchiya | 250/213 VT |
| 4,825,066 | 4/1989 | Nakamura et al. | 250/207 |
| 4,853,595 | 8/1989 | Alfano et al. | 313/532 |

*Primary Examiner*—David C. Nelms
*Assistant Examiner*—T. Davenport

[57] ABSTRACT

A photomultiplier tube in which the a semiconductor photodiode serves as the anode and receives the electrons from the photocathode. The particular geometry for the focusing electrodes in the tube involves a two part structure with one part, the anode focus electrode, in close proximity to the semiconductor photodiode. The second part of the focus structure is a grid focus electrode with two different diameters, located approximately midway between the photodiode and the photocathode and operating on a low voltage. Together the electrodes create a focusing electric field so that the electrons from the large area photocathode are efficiently delivered to the small area of the semiconductor photodiode. The mounting of the photodiode is also designed to act as a termination to furnish superior timing characteristics.

9 Claims, 1 Drawing Sheet

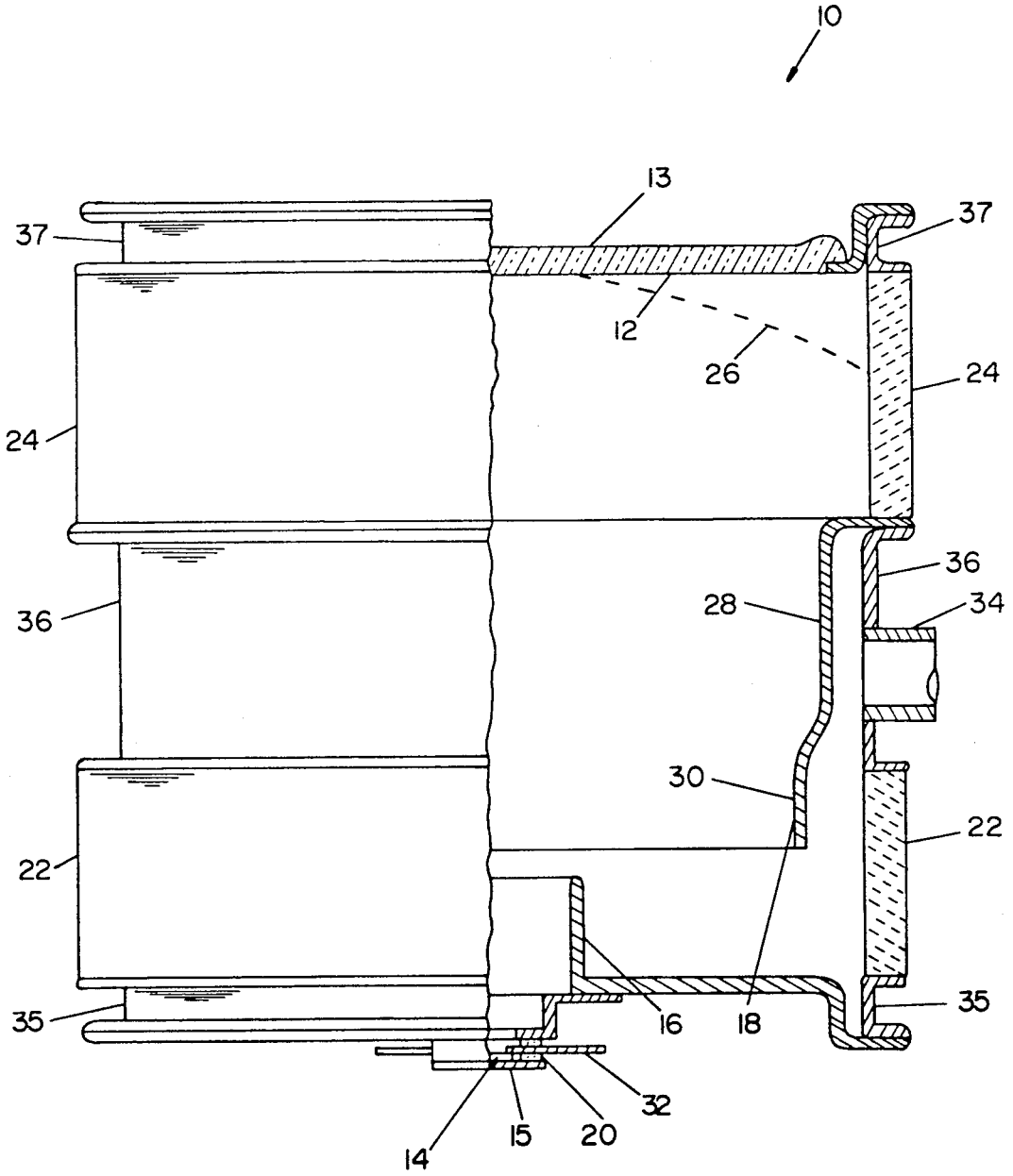
10
13
37
37
12
26
24
24
36
36
28
34
30
22
22
35
35
16
18
32
14
15
20

SEMICONDUCTOR ANODE PHOTOMULTIPLIER TUBE

SUMMARY OF THE INVENTION

This invention deals generally with electric lamp and discharge devices, and more specifically with a photomultiplier tube which contains a semiconductor photodiode serving as an anode to which the electrons emitted from the photocathode are directed.

Although the combination of photocathodes and semiconductor photodiodes in photomultiplier tubes is known, such devices are not in common use, apparently because of difficulties in construction of vacuum devices with large area photocathodes and much smaller area photodiodes. There are, however, certain potential benefits, such as high collection efficiency, superior response time, low power consumption, better gain stability and gain linearity, low noise and simple auxiliary circuitry which are potentially available from such devices, if they can be properly constructed.

Since, with a semiconductor photodiode generating the tube's electrical output signal, the output signal voltages are already in the usual range for semiconductor or integrated circuitry, the circuitry which follows such a tube can take advantage of such technology. Moreover, semiconductor based photomultiplier tubes have a particular advantage when used in systems which require a large number of tubes, since their lower power consumption and simpler associated circuitry is particularly advantageous when consideration is given to the uses of tens or even hundreds of tubes in a single installation.

The present invention furnishes a structure for a semiconductor based photomultiplier which optimizes the desireable characteristic for such a tube. It permits the use of a small surface area photodiode with a much larger area window and photocathode, and it permits the versatility of using a window with two planar surfaces, with one planar and one concave surface or with two concave surfaces.

The present invention also furnishes significantly better transit time spread characteristics than previous tubes and yields a low noise factor. Moreover, a special semiconductor chip carrier allows the use of an output configuration on the tube which can be matched to a transmission line, so that it can function better in high speed applications.

These benefits are attained by the use of a focus electrode structure which includes only two focus electrodes, both of relatively simple construction. One electrode acts as part of the anode, that is, the target for the electrons emitted from the photocathode, and is a simple cylinder located close to the semiconductor chip. The other electrode is a two segment cylinder with a somewhat smaller diameter segment nearer the semiconductor chip and a larger diameter segment nearer the photocathode. This two segment focusing grid electrode is located in the region midway between the photocathode and the semiconductor chip and has a relatively low focusing voltage of less than 200 volts applied to it.

The semiconductor chip carrier is located on the axis of the tube and is constructed so that it can be connected into the circuit within which it operates as a matched transmission line termination. Moreover, the semiconductor chip is spaced along the axis of the tube so that it is located at a focusing crossover region of the electron beam. By this means, the electrons emitted from the large area of the photocathode are brought into a narrow beam so that they will all affect the relatively small area of the photodiode, and a high collection efficiency will result for the tube.

This simple structure, when built with proper geometric dimensions and located in a vacuum envelope using well established photomultiplier tube construction techniques, furnishes operating characteristics superior to those of any semiconductor photomultiplier tube previously available.

BRIEF DESCRIPTION OF THE DRAWING

The FIGURE is a partial cross section view of the photomultiplier tube of the preferred embodiment of the invention.

DETAILED DESCRIPTION OF THE INVENTION

The FIGURE is a partial cross section view along the axis of the preferred embodiment of the photomultiplier tube of the present invention with half of the tube shown in cross section and the exterior view of the other half of the tube shown. Photomultiplier tube 10 is constructed essentially as a coaxial structure with photocathode 12 on the inside of glass window 13, semiconductor photodiode 14 on chip carrier 15 at the end of tube 10 remote from photocathode 12, anode focus electrode 16 near semiconductor photodiode 14, grid focus electrode 18 approximately midway along the tube axis, and suitable ceramic insulting wall portions 20, 22 and 24 and flanges 35, 36 and 37 forming the balance of the vacuum envelope of tube 10.

In the perferred embodiment, semiconductor photodiode 14 is a silicon diode operated in the "electron bombardment induced conductivity" mode, but it is also possible to use a silicon avalanche diode in the same mode, and other types of semiconductor photodiodes will also operate in the configuration of the preferred embodiment. In fact, the silicon avalanche diode is more satisfactory for low light level applications.

Other variations of the preferred embodiment are also possible in the structure of window 13, which can be used as shown in the FIGURE with solid lines as composed of two parallel planar faces, or as shown by dashed line 26 with a curved concave inner surface with a center of curvature within photomultiplier tube 10. In the case of the curved concave inner surface 26 of window 13, its outer surface can be either planar or concave. With either structure for the outer surface and a concave inner surface, the result is actually superior timing characteristics compared to the structure with two planar surfaces and potentially superior cathode collection efficiency for a given small diameter photodiode.

In the preferred embodiment of the invention, the axial length of coaxial photomultiplier tube 10, from photocathode 12 to photodiode 14, is approximately 2.3 inches, while the inside diameter of the envelope formed by insulators 22 and 24 is approximately 2.5 inches. The active diameter of photodiode 14 is only approximately 2.5 millimeters, while the approximate diameter of the photocathode is 50 millimeters. The ratio of the photocathode area to the photodiode area is therefore approximately 400 to one. This exceptionally large ratio is attained by locating photodiode 14 on the tube axis and at the crossover point of the focusing electrical field formed by coaxial focus electrodes 16 and 18.

The location of anode focus electrode 16 in the preferred embodiment is best specified in relation to photodiode 14 and the center axis of tube 10 in that the coaxial cylindrical surface of anode focus electrode 16 is located on a radius approximately 0.33 inches from the center of photodiode 14, which is located on the axis of tube 10. Moreover, anode focus electrode 16 extends axially along tube 10 from photodiode 14 approximately 0.4 inches toward the photocathode.

The location of coaxial grid focus electrode 18 in the preferred embodiment of tube 10 is more easily related to photocathode 12. With the particular dimensions of tube 10 previously specified, the end of grid focus electrode 18 nearer to photocathode 12 is approximately 0.8 inches from the photocathode. Grid focus electrode 18 is constructed with its larger section 28 having an inner diameter of approximately two inches and a length along the tube axis of approximately 0.73 inches, while smaller section 30 has an inner diameter of approximately 1.94 inches and an active axial length of approximately 0.3 inches. For the tube dimensions specified, and with only approximately 100 volts applied to the grid structure described, tube 10 yields a collection efficiency of essentially 100 percent.

A particularly beneficial feature of the invention is the ability to design the connections to semiconductor photodiode 14 to match the external circuitry. Chip carrier 15 acts as the end seal of tube 10. The connections 32 to photodiode 14 which is mounted upon chip carrier 15 can be either wires or strip line connections. This basic structure can be dimensioned so that it has an impedance which will be a matched termination for the following circuitry, and will therefore not adversely affect the rise time of an anode pulse nor introduce spurious signal ringing phenomena.

The other construction features of photomultiplier tube 10 are well understood in the art of tube construction. Exhaust tubulation 34 is attached to external flange 36 to permit appropriate processing and evacuation of gases during tube construction, and electrical feedthrus for other purposes, such as evaporating antimony from beads which are electrically heated to activate photocathode 12, can also penetrate flange 36. Flange 35 and flange 36 also act as the electrical connections by which focus voltages are applied to anode focus electrode 16 and grid focus electrode 18.

The basic structure of ceramic to metal seals is also well understood in the art, so that the details of the assembly of the outer envelope of tube 10 need not be discussed here.

The structure of the present invention furnishes a particularly efficient and fast response time photomultiplier tube which uses very simple auxiliary circuitry. It therefore permits, for the first time, the use of large quantities of photomultiplier tubes in equipment without giving the added problem of heat dissipation from photomultiplier tube divider networks, and it also permits the use of photomultiplier tubes in high speed circuits.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the tube envelope can be constucted with either ceramic or glass, and with either type of insulator, the technology for seals to metal parts is well established in the art.

What is claimed as new and for which Letters patent of the United States are desired to be secured is:

1. A photomultiplier tube comprising:

a sealed envelope from which all gases have been evacuated to form a vacuum suitable for operation of a electron tube within the sealed envelope;

a window which forms a part of the sealed envelope and through which radiation can pass;

a photocathode located on the inside surface of the window, the photocathode emitting electrons when affected by radiation passing through the window, the photocathode having a first voltage applied to it;

a semiconductor photodiode located within the sealed envelope and having a second voltage applied to it, the semiconductor photodiode generating an electrical signal on output connections when it is contacted by electrons from the photocathode, with the electrical signal varying with the quantity of electrons contacting the semiconductor photodiode;

at least an anode focus electrode and a grid focus electrode located within the sealed envelope in the region between the photocathode and the semiconductor photodiode with the anode focus electrode being nearer to the semiconductor photodiode, the focus electrodes being formed of electrically conductive material and having a third electrical voltage applied to the grid focus electrode and a fourth electrical voltage applied to the anode focus electrode so that a focus electrical field is formed within the sealed envelope to direct electrons leaving the photocathode to the semiconductor photodiode.

2. The photomultiplier tube of claim 1 wherein the photocathode, the semiconductor photodiode, and the focus electrodes are oriented in a coaxial configuration.

3. The photomultiplier tube of claim 1 wherein the output connections of the semiconductor photodiode are formed in a configuration which has a specific impedance characteristic which matches the impedance of a circuit external to the photomultiplier tube which is connected to the output connections.

4. The photomultiplier tube of claim 1 wherein the semiconductor photodiode is located on the axis of the photomultiplier tube.

5. The photomultiplier tube of claim 1 wherein the semiconductor photodiode is located at the crossover point of the focus electrical field formed by the voltages applied between it and the photocathode and the focus electrodes.

6. The photomultiplier tube of claim 1 wherein the grid focus electrode is constructed of two segments, the segments having different diameters, and the segment located nearer to the photocathode having a larger diameter.

7. The photomultiplier tube of claim 1 wherein the window is formed with two parallel planar surfaces.

8. The photomultiplier tube of claim 1 wherein the window is formed with a concave inside surface and a planar outside surface.

9. The photomultiplier tube of claim 1 wherein the window is formed with two concave surfaces with the centers of radius of both surfaces being inside the tube.

* * * * *